US007068093B2

(12) United States Patent
Morishita et al.

(10) Patent No.: US 7,068,093 B2
(45) Date of Patent: Jun. 27, 2006

(54) SEMICONDUCTOR INTEGRATED CIRCUIT WITH VOLTAGE ADJUSTING CIRCUIT

(75) Inventors: Fukashi Morishita, Hyogo (JP); Takayuki Gyohten, Hyogo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/336,793

(22) Filed: Jan. 6, 2003

(65) Prior Publication Data

US 2004/0027194 A1 Feb. 12, 2004

(30) Foreign Application Priority Data

Aug. 9, 2002 (JP) ..... 2002-233361

(51) Int. Cl.
*G05F 1/10* (2006.01)
*G05F 3/02* (2006.01)

(52) U.S. Cl. ..... 327/541; 327/543

(58) Field of Classification Search ..... 327/530, 327/538, 540–541, 543, 544, 545; 323/312–313, 323/315–317

See application file for complete search history.

(56) References Cited

U.S. PATENT DOCUMENTS

| | | | | | |
|---|---|---|---|---|---|
| 3,904,989 | A | * | 9/1975 | Cordell | 331/113 R |
| 4,472,675 | A | * | 9/1984 | Shinomiya | 323/314 |
| 5,412,688 | A | * | 5/1995 | Marbot | 375/220 |
| 5,689,178 | A | * | 11/1997 | Otake | 323/282 |
| 5,874,843 | A | * | 2/1999 | Wang | 327/143 |
| 6,353,355 | B1 | * | 3/2002 | Kato | 327/535 |
| 6,570,456 | B1 | * | 5/2003 | Mano et al. | 331/11 |

FOREIGN PATENT DOCUMENTS

| | | |
|---|---|---|
| JP | 6-161580 | 6/1994 |
| JP | 8-6654 | 1/1996 |

* cited by examiner

*Primary Examiner*—Quan Tra
(74) *Attorney, Agent, or Firm*—Leydig, Voit & Mayer, Ltd.

(57) ABSTRACT

A voltage adjusting circuit includes a transistor connected in a current mirror, and a resistor element connected to the transistor. The resistor element has a resistance that changes with temperature, so the voltage level is adjusted according to variations in temperature. Accordingly, stable control of an internal circuit in which desirable operating characteristics change with temperature can be attained, even when temperature varies.

18 Claims, 14 Drawing Sheets

| RESISTOR MATERIAL | RESISTANCE VALUE AT ROOM TEMPERATURE | RESISTANCE VALUE AT HIGH TEMPERATURE | RESISTANCE INCREASE PERCENTAGE |
|---|---|---|---|
| n-poly Si | 100[Ω] | 102.5[Ω] | 2.5% |
| N+DIFFUSION | 100[Ω] | 110[Ω] | 10% |
| P+DIFFUSION | 200[Ω] | 220[Ω] | 10% |

SEMICONDUCTOR INTEGRATED CIRCUIT WITH VOLTAGE ADJUSTING CIRCUIT

BACKGROUND OF THE INVENTION

1. Field of the Invention

The present invention relates to a semiconductor integrated circuit with a voltage adjusting circuit for generating a voltage corresponding to an input voltage.

2. Description of the Background Art

Recently, with the development in the field of information and communications, the prevalence of mobile communication devices such as a mobile phone is prominent. Under such circumstances, the requirement for reducing power consumption of semiconductor integrated circuits, which are employed in such devices, is ever increasing. Among others, in a DRAM (Dynamic Random Access Memory) circuit included in the mobile communication device, a standby state in which no input occurs lasts for a long period. Attempts have been made for reducing the power consumption during the standby state, by adjusting the cycle of so-called self-refresh operation for retaining data during the standby state.

The self-refresh operation is performed as follows: the address of the object to be refreshed is internally generated automatically, and address selection is performed automatically within the DRAM circuit. Further, in response to refresh clock signals periodically generated by an internal refresh timer, the refresh operation is successively performed on prescribed refresh cycle basis.

FIG. 15 illustrates the arrangement of a ring oscillator circuit for generating refresh clock signals.

The ring oscillator circuit has (2n+1) inverters IV (where n is a natural number) connected in series. In FIG. 15, one example is shown where n=3. These inverters are connected in a ring arrangement, with an output of an inverter of the last stage fed back to an input node of an inverter of the first stage. This ring oscillator circuit supplies to the internal circuit refresh clock signals at oscillation frequency corresponding to the operating current of the inverter.

All of the inverters IV have the same arrangement, thus inverter IV of the first stage will be described as a representative. Inverter IV includes transistors PT, NT and NTT. Transistor PT is provided between power supply voltage VCC and node Nd, and receives at its gate an input signal of external clock signal ext.CLK. Further, transistor NT is provided between ground voltage GND via transistor NTT and node Nd, and receives at its gate an input signal of external clock signal ext.CLK. Transistor NTT is serially connected to transistor NT between node Nd and ground voltage GND, and receives at its gate an output voltage from a voltage adjusting circuit 300. As an example, transistor PT is a P-channel MOS transistor. Further, as an example, transistors NT and NTT are N-channel MOS transistors.

Inverter IV complementarily turns transistors PT and NT on in response to the input signal of external clock signal ext.CLK, and supplies to inverter IV of the next stage the voltage level corresponding to the input signal. Here, the gate of transistor NTT receives output voltage Vout generated by voltage adjusting circuit 300 as described above. Thus, operating current of inverter IV is adjusted by voltage adjusting circuit 300. Accordingly, the ring oscillator circuit generates refresh clock signals at oscillation frequency corresponding to the voltage level of the output voltage generated by voltage adjusting circuit 300.

FIG. 16 shows circuit arrangement of voltage adjusting circuit 300 used in the ring oscillator circuit.

Referring to FIG. 16, voltage adjusting circuit 300 includes transistors 301 to 304.

Transistor 301 is provided between a voltage node supplied with power supply voltage VCC and node Na, and has its gate electrically coupled with node Na. Transistor 302 is provided between a voltage node supplied with power supply voltage VCC and output node Nb, and its gate is electrically coupled with node Na. Transistor 303 is provided between ground voltage GND and node Na, and receives at its gate the input signal of input voltage Vin. Transistor 30.4 is provided between output node Nb and ground voltage GND, and receives at its gate input of output node Nb. Here, as an example, transistors 301 and 302 are P-channel MOS transistors. Further, as an example, transistors 303 and 304 are N-channel MOS transistors.

The voltage adjusting circuit generates a constant voltage Vout in response to input voltage Vin by a current mirror formed with transistors 301 and 302. The voltage level of constant voltage Vout is set depending on the size of each of the transistors forming voltage adjusting circuit.

Accordingly, by adjusting output voltage of the voltage adjusting circuit, the refresh operation can normally be performed at accurate cycle.

The refresh cycle of performing refresh operation is determined by the time during which memory cells can retain data, i.e., the data retention period, which in turn depends on leakage current of memory cells. In memory cells sensitive to the variations in temperature, the leakage current of memory cells increases almost three orders of magnitude when temperature rises by 100° C. Therefore, the refresh cycle must properly be set corresponding to the temperature.

On the other hand, since the voltage level of the output voltage of the voltage adjusting circuit above will be the value set corresponding to the size of transistor in the arrangement, the voltage level can not be adjusted corresponding to the variations in the temperature.

Accordingly, when the voltage adjusting circuit is applied to a ring oscillator circuit, for example, the refresh cycle can not properly be adjusted internally. Thus, in order to ensure data retention characteristics of memory cells under high temperatures, the voltage adjusting circuit has been designed to have refresh cycle matched to the performance thereof under high temperatures. Therefore, the refresh operation has been performed with excessive frequency for room temperature or low temperatures, which unnecessarily increases power consumption for refresh operation.

SUMMARY OF THE INVENTION

It is an object of the present invention to provide a semiconductor integrated circuit with a voltage adjusting circuit enabling adjustment of a voltage level corresponding to variations in the temperature.

A semiconductor integrated circuit according to one aspect of the present invention includes a voltage adjusting circuit and an internal circuit. The voltage adjusting circuit generates an output voltage to an output node in response to an input voltage. The internal circuit changes desirable operating characteristics according to variations in the temperature, and is controlled according to the output voltage of the voltage adjusting circuit. The voltage adjusting circuit includes first to fourth transistor units and first and second resistor units. The first transistor unit is provided between a first voltage and an internal node, and has a gate supplied with the input voltage. The second transistor unit is provided between a voltage node supplied with a second voltage and the internal node, and has a gate connected to the internal node. The first resistor unit is provided between the second transistor unit and the voltage node. The third transistor unit is provided between the voltage node and the output node so as to form a current mirror with the second transistor unit, and has a gate connected to the internal node. The fourth transistor unit is provided between the output node and the first voltage, and has a gate connected to the output node. The second resistor unit is provided between the fourth transistor unit and the first voltage. The first and second resistor units have resistance characteristics in which a resistance value changes according to. variations in the temperature.

The semiconductor integrated circuit according to the present invention has resistance characteristics in which the first and second resistor units change their resistance values corresponding to variations in the temperature. Thus, the voltage adjusting circuit can adjust the output voltage corresponding to variations in the temperature. Accordingly, the principal advantage of the semiconductor integrated circuit according to the present invention is the achievement of a stable control in the internal circuit where desirable operating characteristics change corresponding to variations in the temperature, retaining desirable operating characteristics even when temperature varies.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
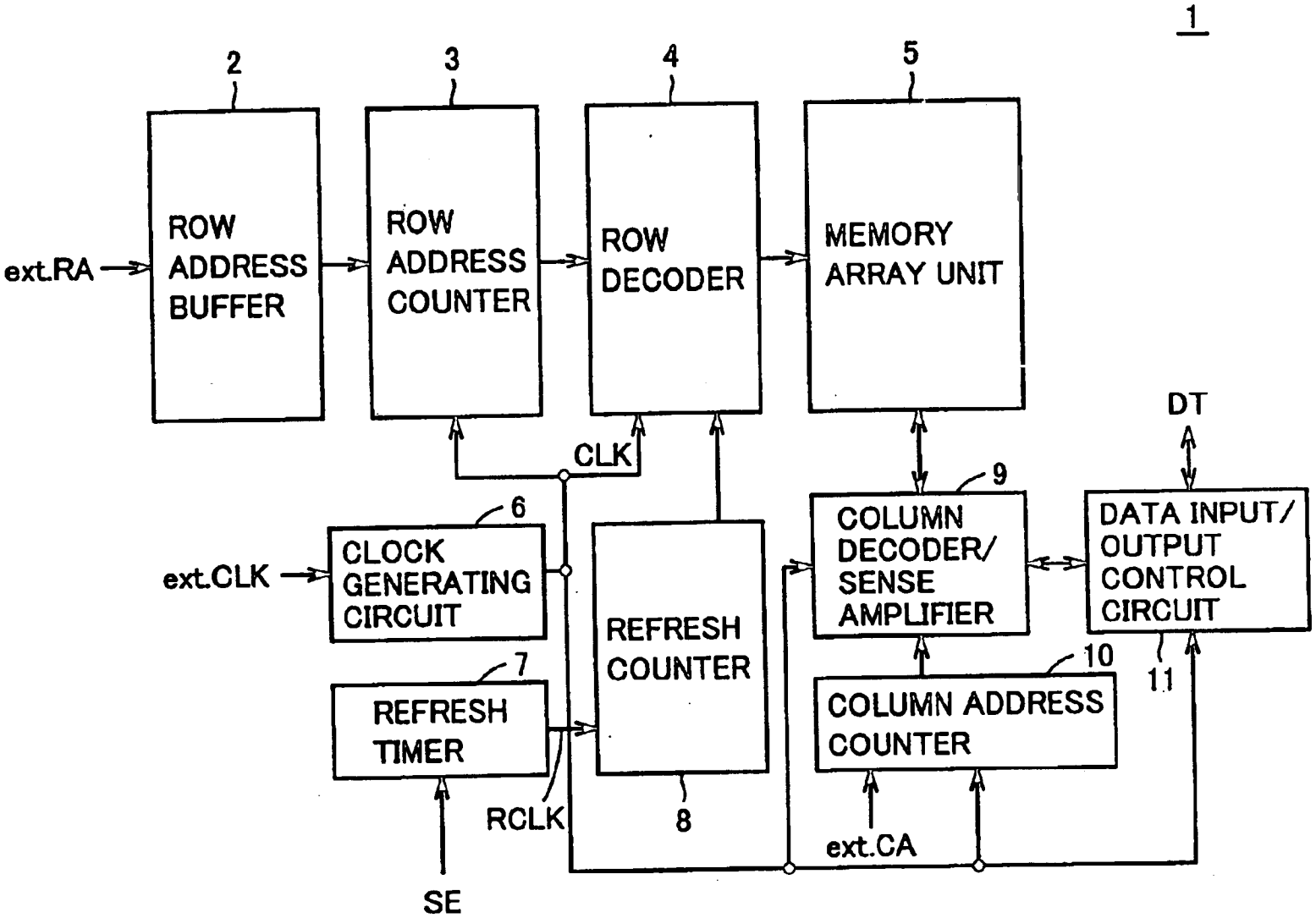
FIG. 1 illustrates overall arrangement of a semiconductor memory device showing an application of voltage adjusting circuit according to a first embodiment of the present invention.

Referring to the figures, preferred embodiments of the present invention will be described in detail. In the drawings, the same or similar parts are given the same reference characters, and the description thereof will not be repeated.

First Embodiment

Referring to FIG. 1, a semiconductor memory device 1 includes: a row address buffer 2 for buffering externally input row address signal ext.RA to output the same to a row address counter 3; row address counter 3 for synchronizing row address signal ext.RA received from row address buffer 2 with internal clock signal CLK to perform a counting operation, and generating internal row address signal to output the same to a row decoder 4; row decoder 4 for performing row selection at a memory array unit 5 selecting either one of an internal row address, resulted from decoded internal row address signal output from row address counter 3, or a refresh address, which will be described below; and a memory array unit 5 having a plurality of memory cells (not shown) arranged in rows and columns for storing data.

Semiconductor memory device 1 further includes: a clock generating circuit 6 for generating internal dock signal CLK in response to an input of external dock signal ext.CLK; a refresh timer 7 for generating refresh clock signal RCLK for determining executing cycle of refresh operation in response to self/auto refresh select signal SE; a refresh counter 8 for counting up refresh row address synchronizing with refresh clock signal RCLK upon refresh operation to output refresh address; a column address counter 10 for counting up column address by synchronizing with internal clock signal CLK and generating an internal column address in response to column address signal ext. CA; a column decoder/sense amplifier 9 for performing column selection of memory array unit 5 in response to the internal column address generated by row address counter 10 and for amplifying the read data and outputting the same to data input/output control circuit 11; and a data input/output control circuit 11 for controlling data communication of external data DT with column decoder/sense amplifier 9.

Figure 2:
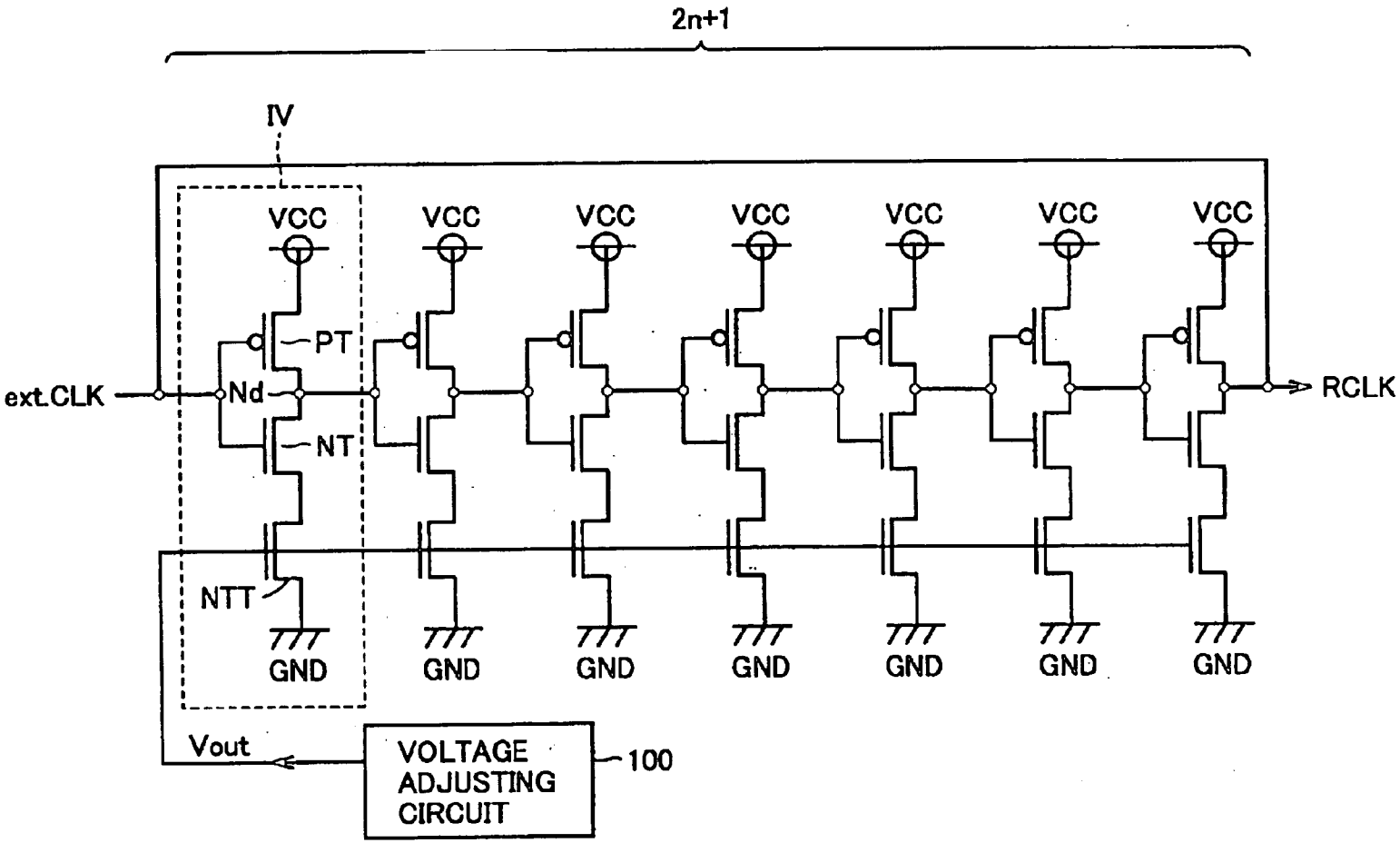
FIG. 2 is a schematic view in which voltage adjusting circuit according to the first embodiment of the present invention is applied to a ring oscillator circuit.
Figure 15:
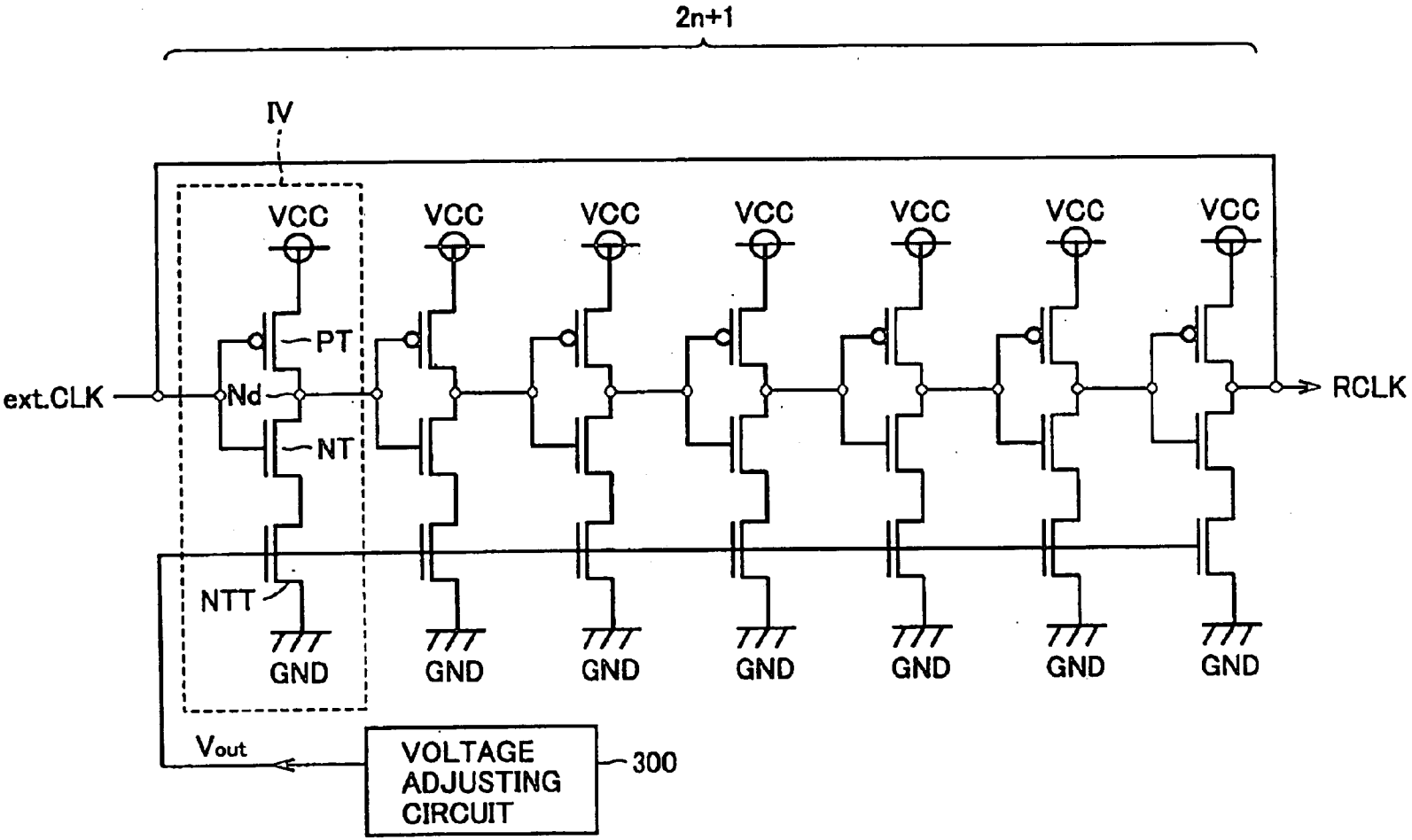
FIG.15 PRIOR ART
FIG. 15 is a circuit diagram showing an arrangement of a ring oscillator circuit for generating refresh clock signals.
Figure 16:
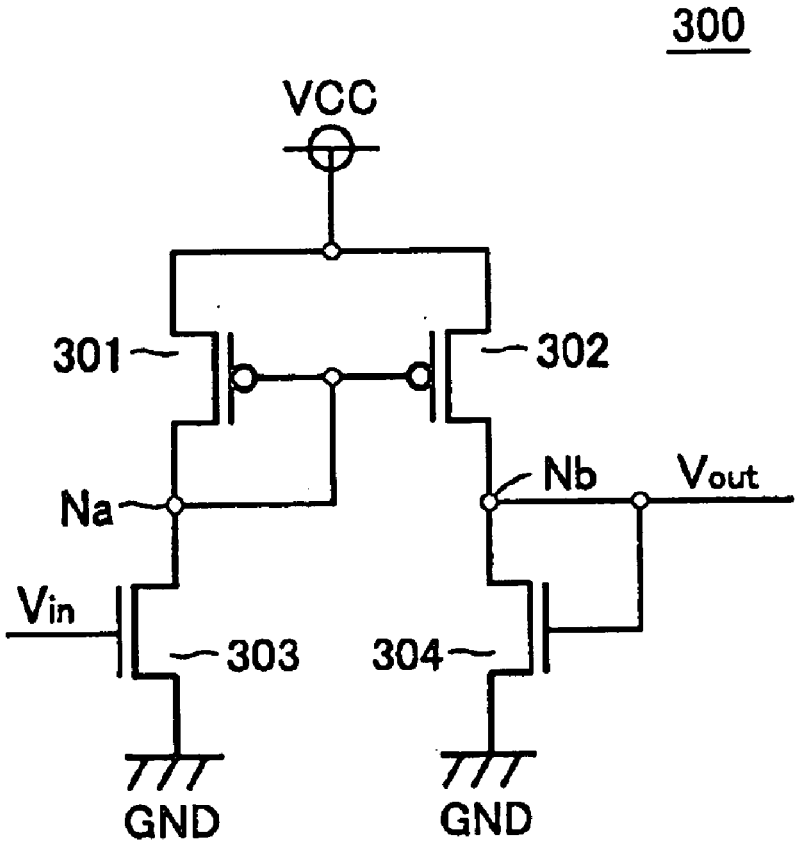
FIG.16 PRIOR ART
FIG. 16 is a circuit diagram showing an arrangement of a voltage adjusting circuit employed in the ring oscillator circuit of FIG. 15.

Referring to FIG. 2, a ring oscillator circuit according to a first embodiment of the present invention is different from the ring oscillator circuit of FIG. 15 in that voltage adjusting circuit 300 is replaced by a voltage adjusting circuit 100. The rest of the arrangement is the same as that of the ring oscillator circuit in FIG. 15, thus the detailed description thereof will not be repeated.

Figure 3:
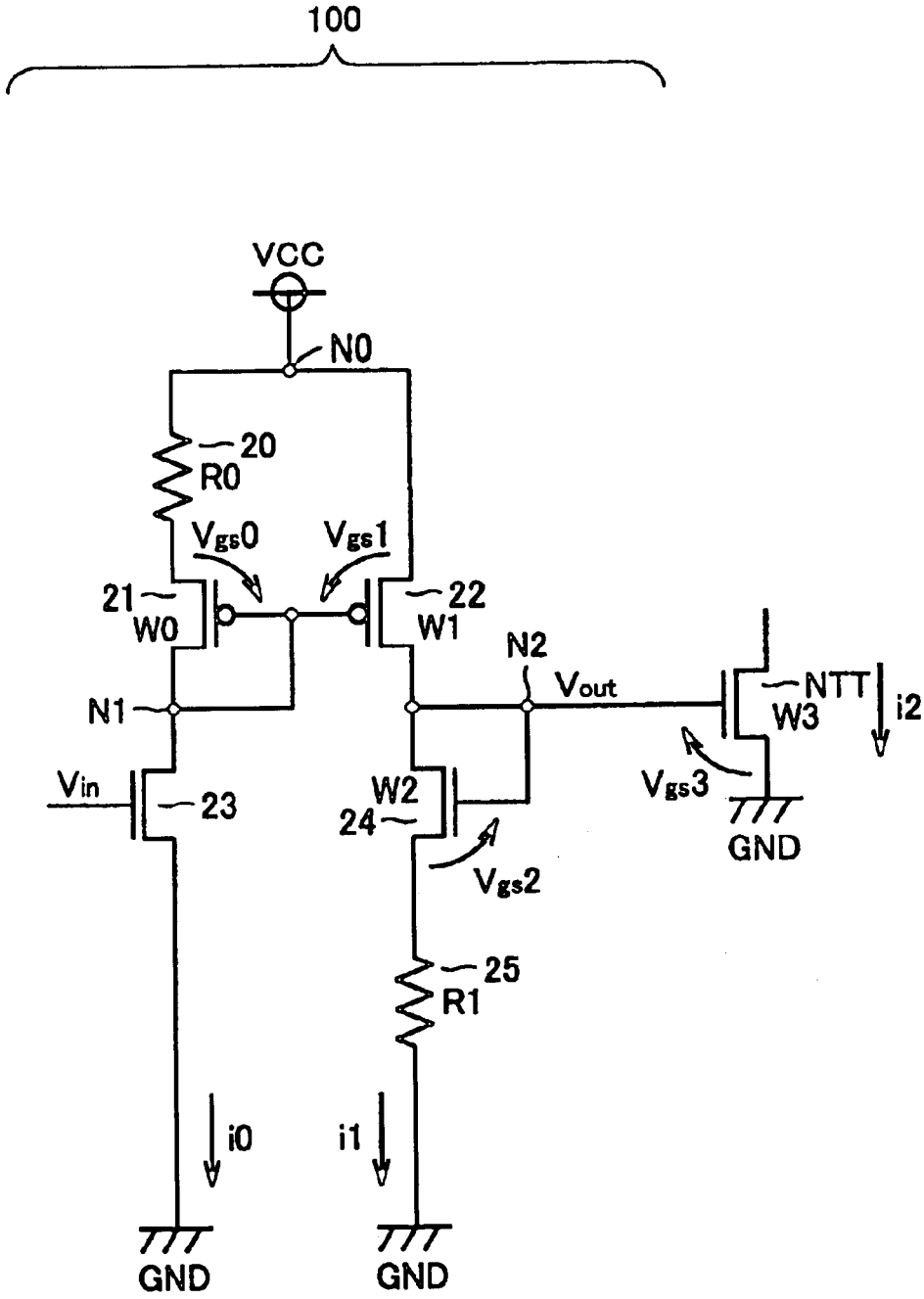
FIG. 3 is a circuit diagram showing an arrangement of a voltage adjusting circuit and a transistor driven by the voltage adjusting circuit according to the first embodiment of the present invention.

Referring to FIG. 3, voltage adjusting circuit 100 according to the first embodiment of the present invention includes resistors 20 and 25, and transistors 21 to 24.

Transistor 23 is provided between ground voltage GND and node N1, and receives at its gate input voltage Vin. Resistor 20 and transistor 21 are connected in series between node N0 supplied with power supply voltage VCC and node N1, and the gate of the transistor 21 is electrically coupled with node N1. Transistor 22 is provided between nodes N0 and N2 so as to form a current mirror with transistor 21, and its gate is electrically coupled with node N1. Transistor 24 and resistor 25 are provided between node N2 and ground voltage GND, and the gate of transistor 24 is electrically coupled with node N2. Transistor NTT has its source electrically coupled with ground voltage GND, and has its gate electrically coupled with node N2. The polarity of transistors 21 and 22, and that of transistors 23 and 24 are different from each other, and as an example, transistors 21 and 22 are assumed to be P-channel MOS transistors. Additionally, as an example, transistors 23 and 24 are assumed to be N-channel MOS transistors. Resistors 20 and 25 have resistor characteristics that the resistance value changes according to the temperature.

Here, a constant current i2 flows through transistor NTT which receives at its gate output voltage generated by voltage adjusting circuit 100.

Consider this constant current i2 flowing through transistor NTT.

For example, assume that, in voltage adjusting circuit 100, a current i0 flows through resistor 20 at the input side, and a current i1 flows through resistor 25 at the output side. Resistors 20 and 25 are respectively assumed to have resistance value R0 and R0. Transistors 21, 22, 24, and NTT are respectively assumed to have gate width of W0, W1, W2, and W3.

Then, in the current mirror formed with transistors 21 and 22, for current i1 flowing through transistor 22, following relational expression can be obtained based on the values above:

$$Vgs\mathbf{1}(i\mathbf{1})=Vgs\mathbf{0}(i\mathbf{0})+i\mathbf{1}\times R\mathbf{0} \tag{1}$$

where Vgs0 (i0) and Vgsl1 (i1) respectively indicate gate-source voltage of transistors 21 and 22, passing current i0 and i1 respectively.

Figures 4, 5:
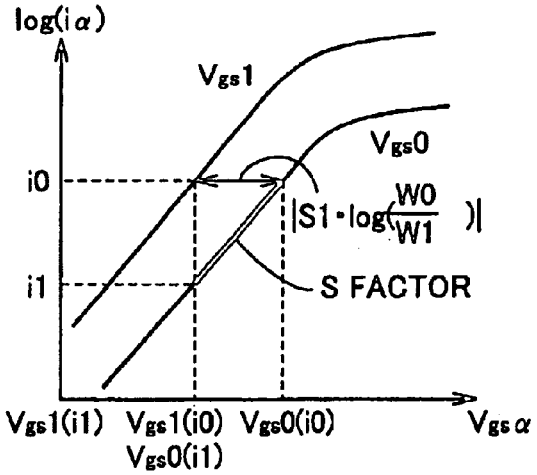
FIG. 4 is a graph showing transistor characteristics.
FIG. 5 is a table showing resistance characteristics indicating resistance values varying based on resistor materials forming resistors and temperature.

Referring to FIG. 4, in the graph showing transistor characteristics of transistors 21 and 22, the vertical axis indicates the value of log (iα), the lateral axis indicates gate-source voltage Vgsα, and α is an arbitrary value.

For example, referring to FIG. 3, when current i0 flows through transistor 21, gate-source voltage indicates voltage Vgs0 (i0). When current i1 flows therethrough, gate-source voltage indicates voltage Vgs0 (i1) due to its transistor characteristics.

Referring to FIG. 3, when current i0 flows through transistor 22, gate-source voltage indicates voltage Vgs1 (i0). When current i1 flows therethrough, gate-source voltage indicates voltage Vgs1 (i1) due to its transistor characteristics.

Thus, using S factor (=S1), the following expression can be derived.

$$Vgs0(i0)-Vgs1(i0)=S1\times\{\log(i0)-\log(i1)=S1\times\log\frac{i0}{i1} \tag{2}$$

Further, log (i0/i1) in the expression above can approximate to the gate width ratio of transistors 21 and 22 log (W0/W1). Accordingly, the expression above satisfies the following expression.

$$Vgs0(i0)-Vgs1(i0)=S1\times\log\frac{W0}{W1} \tag{3}$$

This S factor indicates so-called switching characteristics of transistors, and it is expressed by reciprocal of gradient to the gate voltage. Smaller S factor value results in better switching characteristics and smaller gate leakage current.

The S factors of transistors 21 and 22 are approximately the same value and satisfy the following expression.

$$S1=\frac{\log(i0)-\log(i1)}{Vgs0(i0)-Vgs0(i1)}\approx\frac{\log(i0)-\log(i1)}{Vgs1(i0)-Vgs1(i1)} \tag{4}$$

Using these expressions (1), (2) and (4), gate-source voltage Vgs is eliminated and the following expression (5) can be derived.

$$\log(i1)=\log\left(i0\times\frac{W1}{W0}\right)+\frac{i0\times R0}{S1} \tag{5}$$

Similarly, in the current mirror formed with transistor 24 and transistor NTT, for current i2 flowing through transistor NTT, the following relational expression can be derived. Again, the following relational expression can be derived according to the same scheme described above. It should be noted that S factor of transistor 24 and transistor NTT is denoted as S2.

$$Vgs\mathbf{3}(i\mathbf{2})=Vgs\mathbf{2}(i\mathbf{1})+i\mathbf{1}\times R\mathbf{1} \tag{6}$$

$$Vgs2(i1)-Vgs3(i1)=S2\times\log\left(\frac{W2}{W3}\right) \tag{7}$$

$$S2=\frac{\log(i2)-\log(i1)}{Vgs2(i2)-Vgs2(i1)}\approx\frac{\log(i2)-\log(i1)}{Vgs3(i2)-Vgs3(i1)} \tag{8}$$

Based on the expressions (6) to (8), the following expression can be derived.

$$\log(i2)=\log\left(i1\times\frac{W3}{W2}\right)+\frac{i1\times R1}{S2} \tag{9}$$

Based on the expressions (5) and (9), current i2 satisfies the following relational expression.

$$\log(i2)=\frac{i0\times R1\times W1}{S2\times W0}\times 10^{\frac{i0\times R0}{S1}}+\frac{i0\times R0}{S1}+\log\frac{W1\times W3\times i0}{W0\times W2} \tag{10}$$

As above, according to the expression (10), current i2 is set at the value corresponding to current i0 as well as gate width of a transistor, resistance and S factor, which are determined by device arrangement. Thus, by setting gate width, resistance and S factor so as to satisfy these relational expressions, desired current i2 can be supplied to transistor NTT.

Next, referring to FIG. 5, description will be given on the resistor characteristics which indicates resistance values that vary based on resistor materials of resistors 20 and 25 and temperature variation.

Specifically, in a resistor employing an n-poly Si (n type polysicon) as a resistor material, its resistance value increases by 2.5% when the temperature changes from room temperature to high temperatures. For example, when the n type polysilicon is employed as a resistor material, the resistance value changes from 100 Ω of to 102.5 Ω. As used herein, "high temperatures" generally refer to temperatures from 70° C. to 80° C., or higher. In a transistor employing an $N^+$ diffusion layer as a resistor material, its resistance value increases by 10% when the temperature changes from room temperature to high temperatures. For example, when employing an $N^+$ layer as a resistor material, the resistance value increases from 100 Ω to 110 Ω. A resistor employing a $P^+$ diffusion layer as a resistor material increases its resistance value by 10% when the temperature changes from room temperature to high temperatures. For example, when employing the $P^+$ diffusion layer as a resistor material, the resistance value changes from 200 Ω to 220 Ω.

In the foregoing, materials having so-called positive resistance characteristics have been described, in which the resistance value increases as the temperature rises. Nevertheless, it is not limited to these materials, and materials having so-called negative resistance characteristics, in which the resistance value decreases as the temperature rises, may also be employed. Specifically, by employing non-doped silicon (Si) or germanium (Ge) as a resistor material, a resistor with the so-called negative resistance characteristics can be implemented.

As an example, consider a case where the resistance value of resistor R0s is 10 kΩ and that of resistor R1 is 100 kΩ, in order to attain current I2 of 10 μA flowing through transistor NTT at room temperature. Following values are assumed: S factor=0.1 V/dec, current i0=1 μA, gate widths W0=W1, W2=10×W3.

Assume that the resistance value increases by 10% when the temperature changes to high temperatures.

Then, by calculating with the expression (10) above, current may be set at 30.5 μA.

Therefore, by using voltage adjusting circuit 100 according to the first embodiment of the present invention, the voltage level generated corresponding to the variations in the temperature can be adjusted, and thus, the current amount flowing through transistor NTT can be adjusted. Specifically, by forming the resistor in the arrangement of the voltage adjusting circuit with a resistor material having resistor characteristics that changes based on the variations in the temperature, the voltage level can be adjusted to the desired value corresponding to temperature variation.

Accordingly, by using voltage adjusting circuit 100, the amount of operating current of an inverter forming a ring oscillator circuit can be adjusted according to the variations in the temperature. Specifically, the resistance value of the resistor forming the voltage adjusting circuit is different at room temperature and at high temperatures, thus the operating current amount of the inverter can be increased at high temperatures to be greater than at room temperature. Therefore, the oscillation frequency of refresh clock signals can be set higher at high temperatures than at room temperature (at low temperatures).

First Variation of First Embodiment

A first variation of the first embodiment of the present invention is an arrangement for tuning a voltage level generated by a voltage adjusting circuit.

Figure 6:
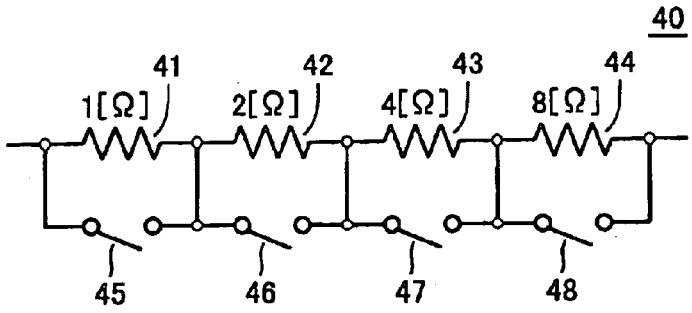
FIG. 6 is a schematic view of variable resistance circuit replaceable with resistors of a voltage adjusting circuit.

Referring to FIG. 6, a variable resistance circuit 40, which is replaceable with resistors 20 and 25 of voltage adjusting circuit 100 of FIG. 2, includes resistors 41 to 44, and switching elements 45 to 48 forming shorting path for short-circuiting each resistor element.

Here, as an example, resistors 41 to 44 are respectively set at 1 Ω, 2 Ω, 4 Ω, and 8 Ω.

Resistance variable circuit 40 may tune the combined resistance of variable resistance circuit 40 by selectively rendering switching elements 45 to 48 conductive. Accordingly, the resistance value in the expression (10) above can be adjusted for tuning to the desired voltage level.

Additionally, as in the example above, by setting resistance values of resistors 41 to 44 respectively to the power of 2 and different from each other, the resistance values can be tuned in equal intervals. Specifically, when n numbers of resistors are provided, nth power of 2 of combined resistance values can be tuned in equal intervals. For example, fourth power of 2, i.e., 16 numbers of the resultant resistance values can be tuned in equal intervals in the example above. Thus, tuning of the combined resistance can be performed easily.

The arrangement has been described in which four resistance elements, resistors 41 to 44, are selectively rendered conductive for tuning. Nevertheless, the number of the elements are not limited to a specific number. It is also possible to tune combined resistance by using fuses as switching elements 45 to 48, by selectively blowing the fuses. Additionally, by using an MOS transistor to implement the switching element, shorting path can selectively be formed in response to a control signal provided at the gate. Tuning of the combined resistance may also be performed.

Second Variation of First Embodiment

Figure 7:
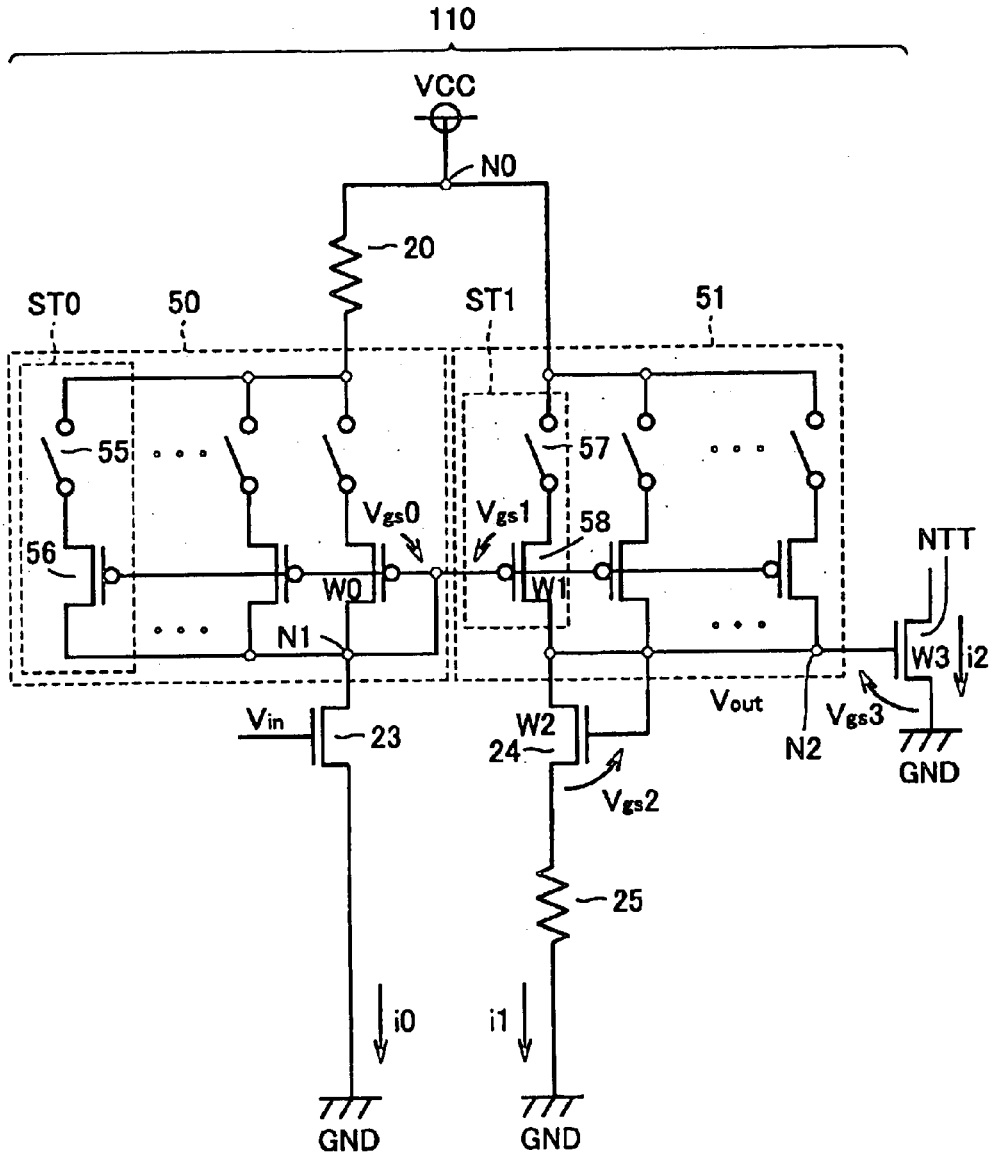
FIG. 7 is a circuit diagram showing an arrangement of a voltage adjusting circuit and transistor according to a second variation of the first embodiment of the present invention.

Referring to FIG. 7, a voltage adjusting circuit 110 according to a second variation of the first embodiment of the present invention is different from voltage adjusting circuit 100 in that transistor 21 is replaced by a connection switching circuit 50, and transistor 22 is replaced by a connection switching circuit 51. The rest of the arrangement is the same as that of voltage adjusting circuit 100 of the first embodiment shown in FIG. 3, thus the detailed description thereof will not be repeated.

Connection switching circuit 50 includes a plurality of connection switching units ST0, connected between resistor 20 and node N1 parallel to each other. Connection switching unit ST0 includes serially connected switching element 55 and transistor 56, which is electrically coupled between resistor 20 and node N1 via switching element 55, and has a gate connected to node N1. Other connection switching units ST0 have the same arrangement, thus the detailed description thereof will not be repeated.

Connection switching circuit 51 includes a plurality of connection switching units ST1 provided parallel to each other between node N0 and node N2. Connection switching units ST1 includes serially connected switching element 57 and transistor 58, which is electrically coupled between node N0 and node N2 via switching element 57, and has a gate connected to node N1. Other connection switching units ST1 have the same arrangement, thus the detailed description thereof will not be repeated.

For example, transistors forming connection switching circuits 50 and 51 are selectively switched using switching elements. Thus, values of gate width W0 and W1 can be adjusted. Specifically, values of gate width W0 and W1 of the expression (10) above can be adjusted for tuning output voltage to desired voltage level.

Further, tuning of the gate width of the transistors can also be attained by using fuses as switching elements by blowing fuses selectively. It is also possible to form switching elements using MOS transistors, in order to form a shorting path selectively in response to a control signal applied to the gate of the MOS transistor. Tuning of gate width of the transistor can also be attained.

In the foregoing, though the arrangement in which both of connection switching circuits 50 and 51 are provided has been described, it is also possible to employ only one of them.

Second Embodiment

A second embodiment of the present invention is directed to an arrangement for suppressing noises to a voltage adjusting circuit.

Figure 8:
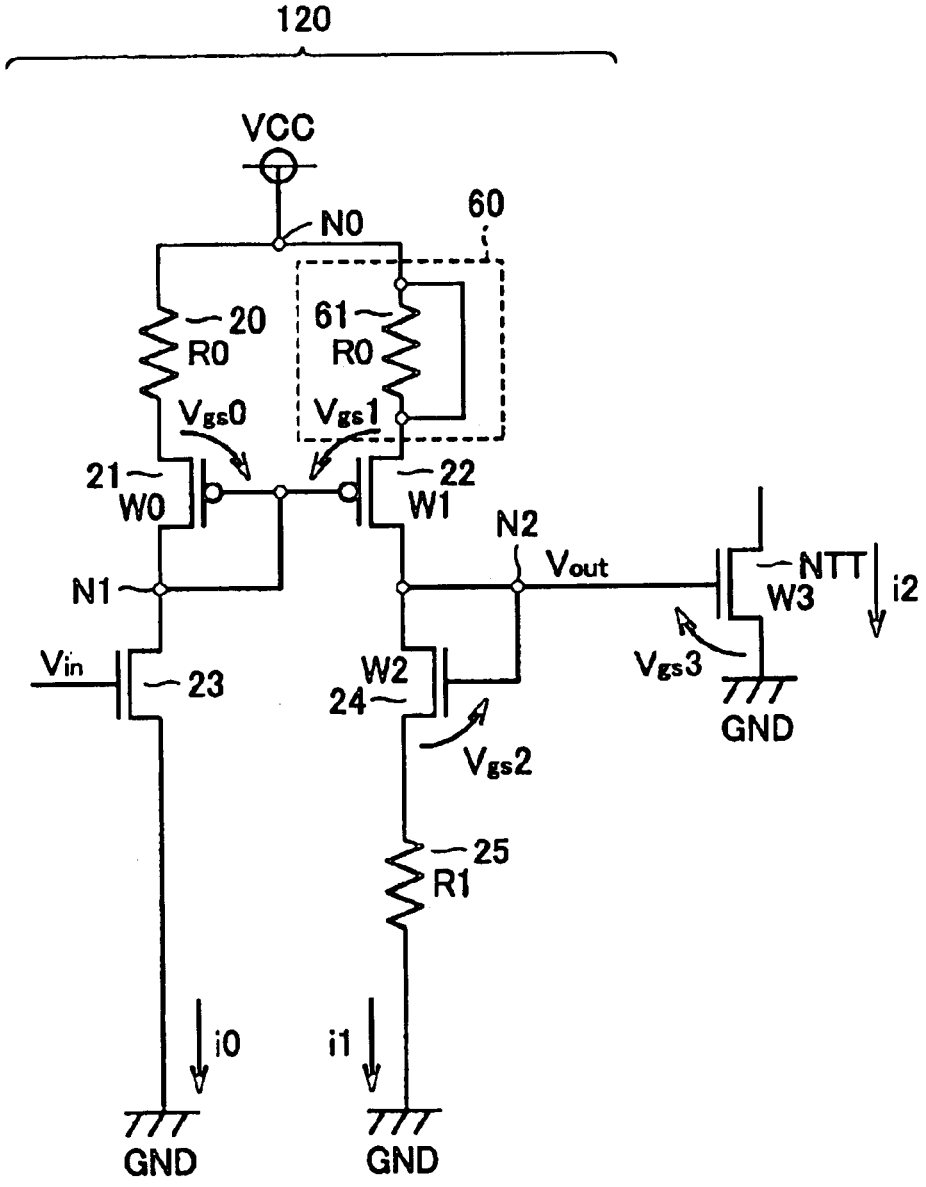
FIG. 8 is a circuit diagram showing an arrangement of a voltage adjusting circuit and transistor according to a second embodiment of the present invention.

Referring to FIG. 8, a voltage adjusting circuit 120 of the second embodiment of the present invention is different from voltage adjusting circuit 100 in that a noise canceler 60 for suppressing noise is interposed between voltage node N0 and transistor 22. The rest of the arrangement is the same as that of voltage adjusting circuit 100 of the first embodiment shown in FIG. 3, thus the detailed description thereof will not be repeated.

Noise canceler 60 has a dummy resistor 61 having the same resistance value as resistor 20, and a shorting path for short-circuiting dummy resistor 61.

By employing this arrangement, power supply noises from node N0 and noises from upper interconnections are received by both of resistors 20 and 61. Specifically, by employing the arrangement in which resistors 20 and 61 are respectively interposed between node N0 and transistor 21, and node N0 and transistor 22, symmetry of the circuit can be maintained, and thus the noises can be cancelled. Thus, even when power supply noises and the like are generated on voltage adjusting circuit 120, the noises are cancelled and a desired voltage level may be generated accurately.

First Variation of Second Embodiment

Figure 9:
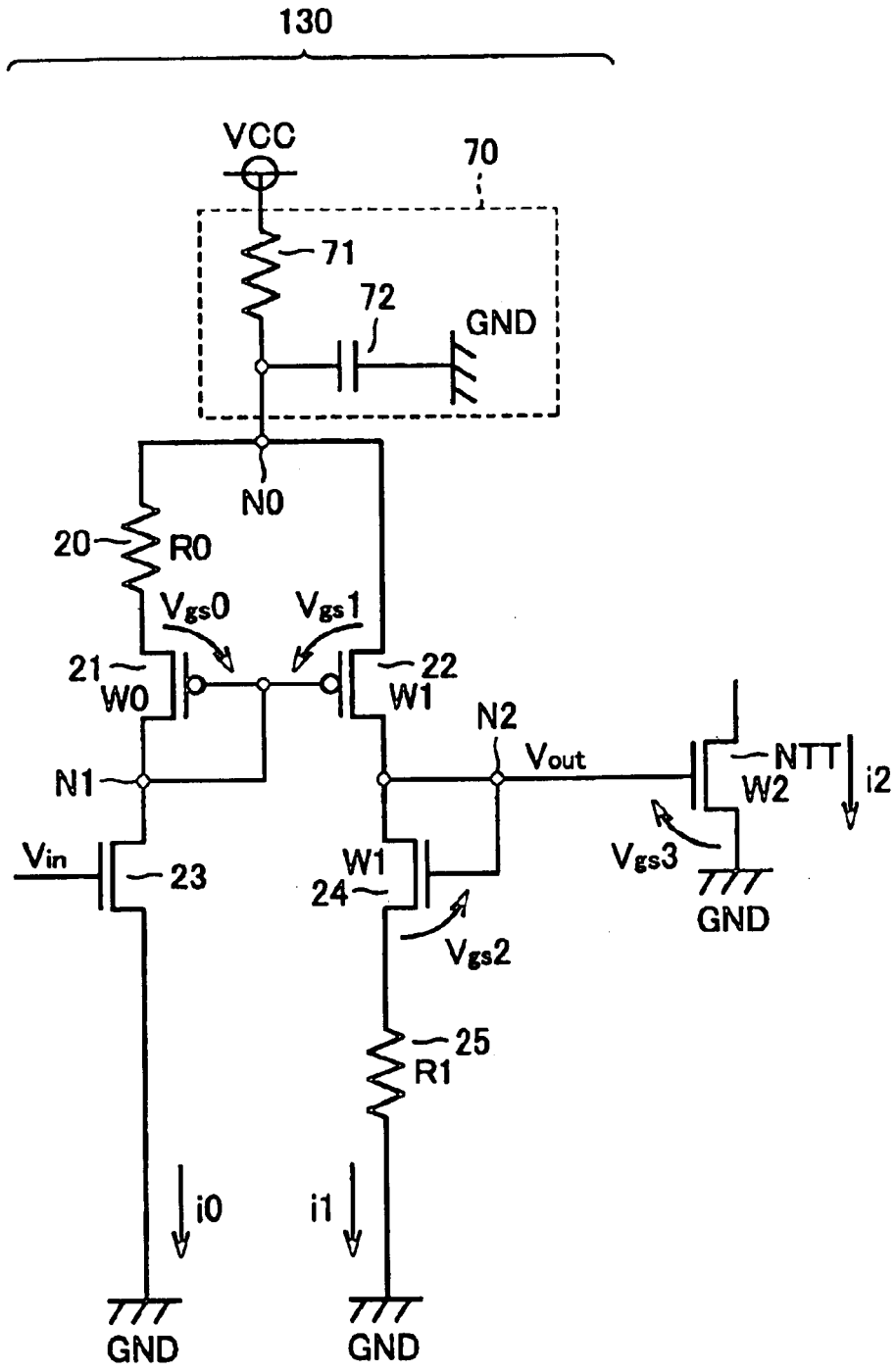
FIG. 9 is a circuit diagram showing an arrangement of a voltage adjusting circuit and a transistor according to a first variation of the second embodiment of the present invention.

Referring to FIG. 9, a voltage adjusting circuit 130 according to a first variation of the second embodiment of the present invention is different from voltage adjusting circuit 100 shown in FIG. 3 in that a filter 70 is provided between power supply voltage VCC and node N0 supplied with power supply voltage VCC. The rest of the arrangement is the same as voltage adjusting circuit. 100 of the first embodiment shown in FIG. 3, thus the detailed description thereof will not be repeated.

Filter 70 includes a resistor element 71 provided between power supply voltage VCC and node N0, and a capacitor 72 provided between node N0 and ground voltage GND and parallel to resistor element 71. The circuit arrangement of filter 70 corresponds to a so-called low-pass filter for attenuating signals of high frequency band.

According to the arrangement of voltage adjusting circuit 130 of the first variation of the second embodiment of the present invention, power supply noises of high frequency band signals are suppressed by using filter 70, and thus a desired voltage level can be generated accurately.

Second Variation of Second Embodiment

Figure 10:
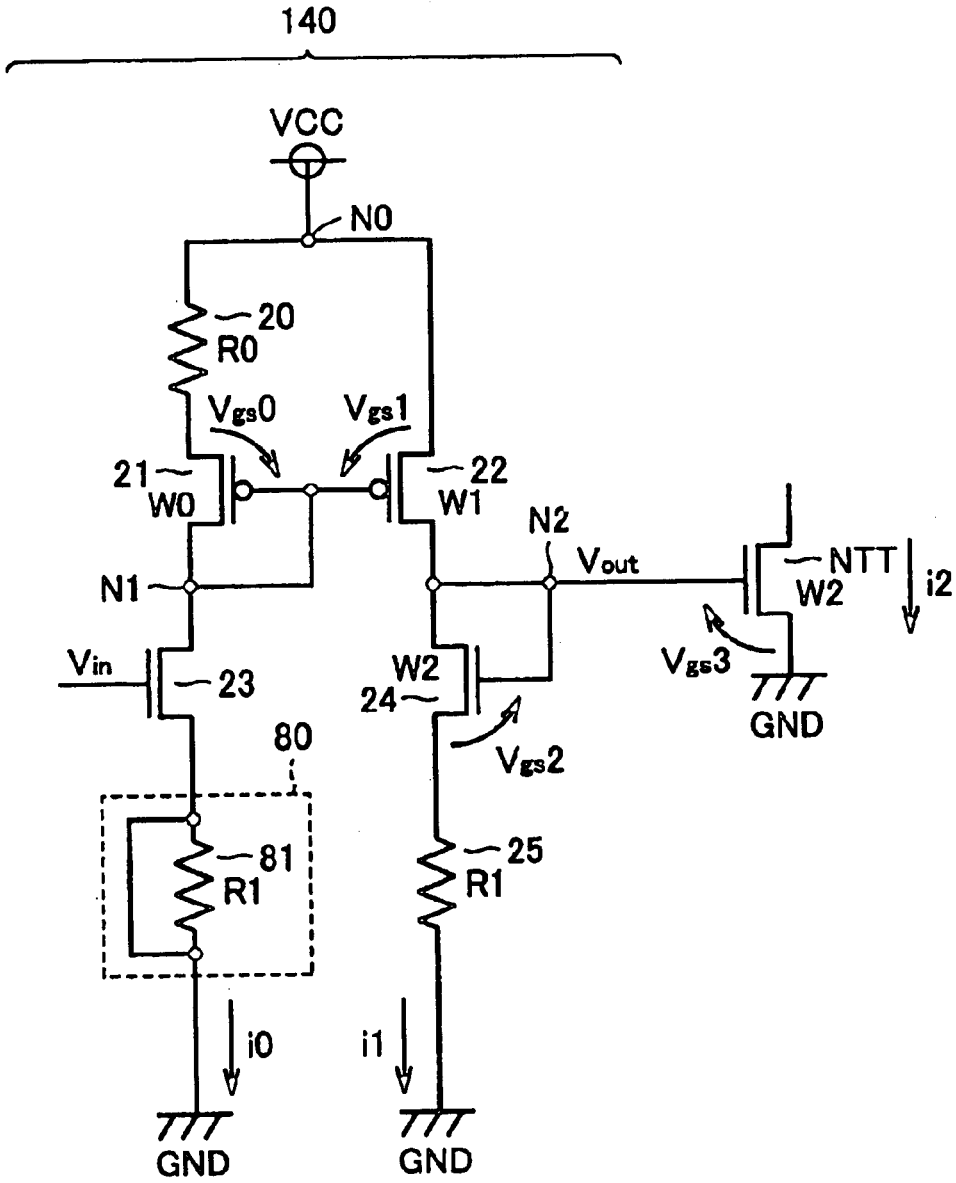
FIG. 10 is a circuit diagram showing an arrangement of a voltage adjusting circuit and a transistor according to a second variation of the second embodiment of the present invention.

Referring to FIG. 10, a voltage adjusting circuit 140 according to a second variation of the second embodiment of the present invention is different from voltage adjusting circuit 100 shown in FIG. 3 in that a noise canceler 80 is provided between transistor 23 and ground voltage GND. The rest of the arrangement is the same as that of voltage adjusting circuit 100 of the first embodiment shown in FIG. 3, thus the detailed description thereof will not be repeated.

Noise canceler 80 has a dummy resistor 81 similar to resistor 25 and a shorting path for shorting dummy resistor 81. By employing this arrangement, the symmetry of the circuit formed with dummy resistors 81, similar to resistor 25, enables cancellation of the noises as described in the second embodiment. Thus, even when ground voltage noises and the like are generated on voltage adjusting circuit 140 from ground voltage GND, the noises can be suppressed and a desired voltage level can be generated accurately.

Third Variation of Second Embodiment

Figure 11:
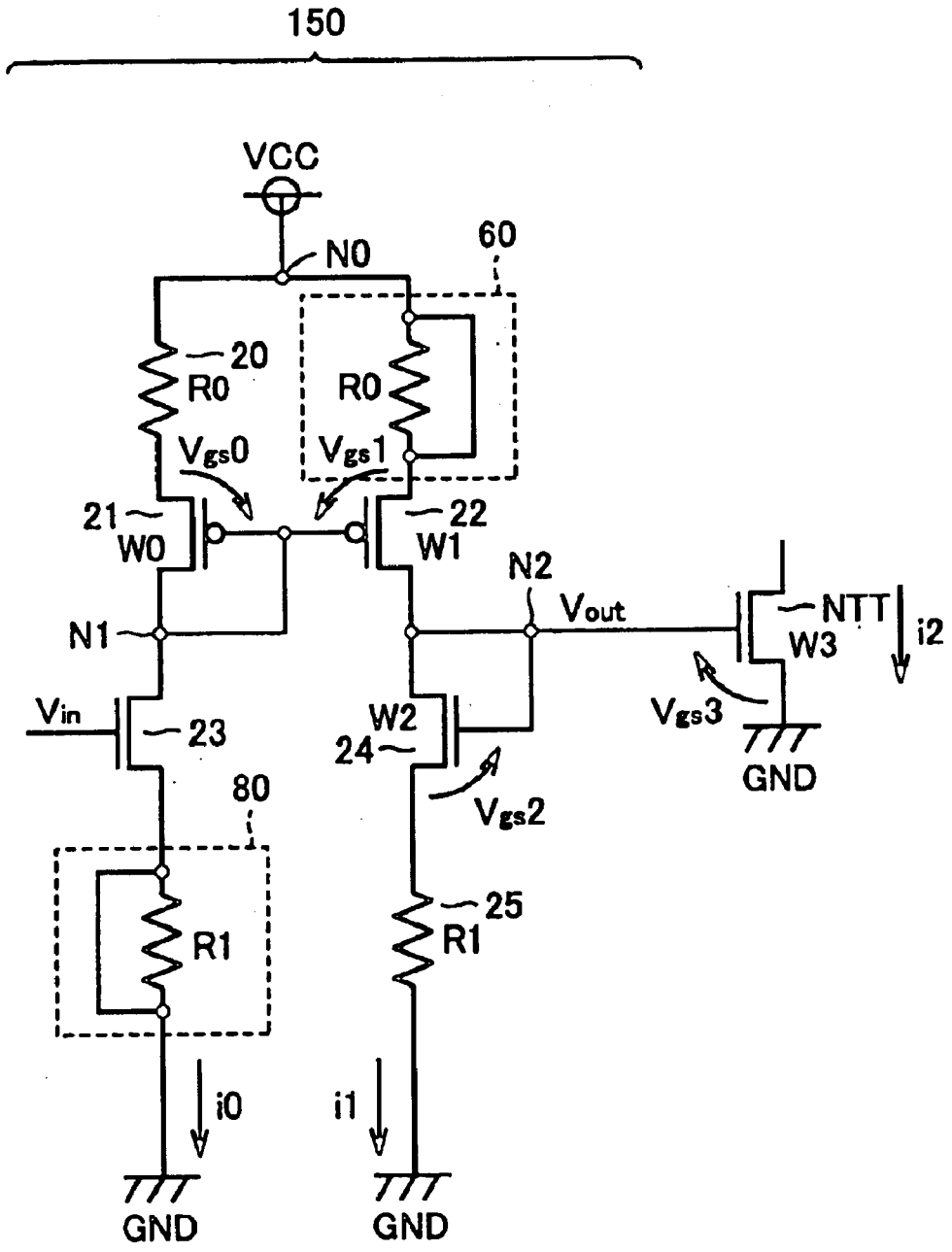
FIG. 11 is a circuit diagram showing an arrangement of a voltage adjusting circuit and a transistor according to a third variation of the second embodiment of the present invention.

Referring to FIG. 11, voltage adjusting circuit 150 according to a third variation of the second embodiment of the present invention is different from voltage adjusting circuit 140 according to the second variation of the second embodiment in that a noise canceler 60 is provided between node N0 and transistor 22. The rest of the arrangement is the same with that of voltage adjusting circuit 140 according to the second variation of the second embodiment shown in FIG. 10, thus the detailed description thereof will not be repeated.

With this arrangement, the symmetry of the circuit can be maintained to suppress power supply noises from power supply voltage VCC and ground voltage noises from ground voltage GND as described above, and thus a desired voltage level can be generated accurately.

Third Embodiment

A third embodiment of the present invention describes an arrangement of voltage adjusting circuit which reduces the power consumption during standby state.

Figure 12:
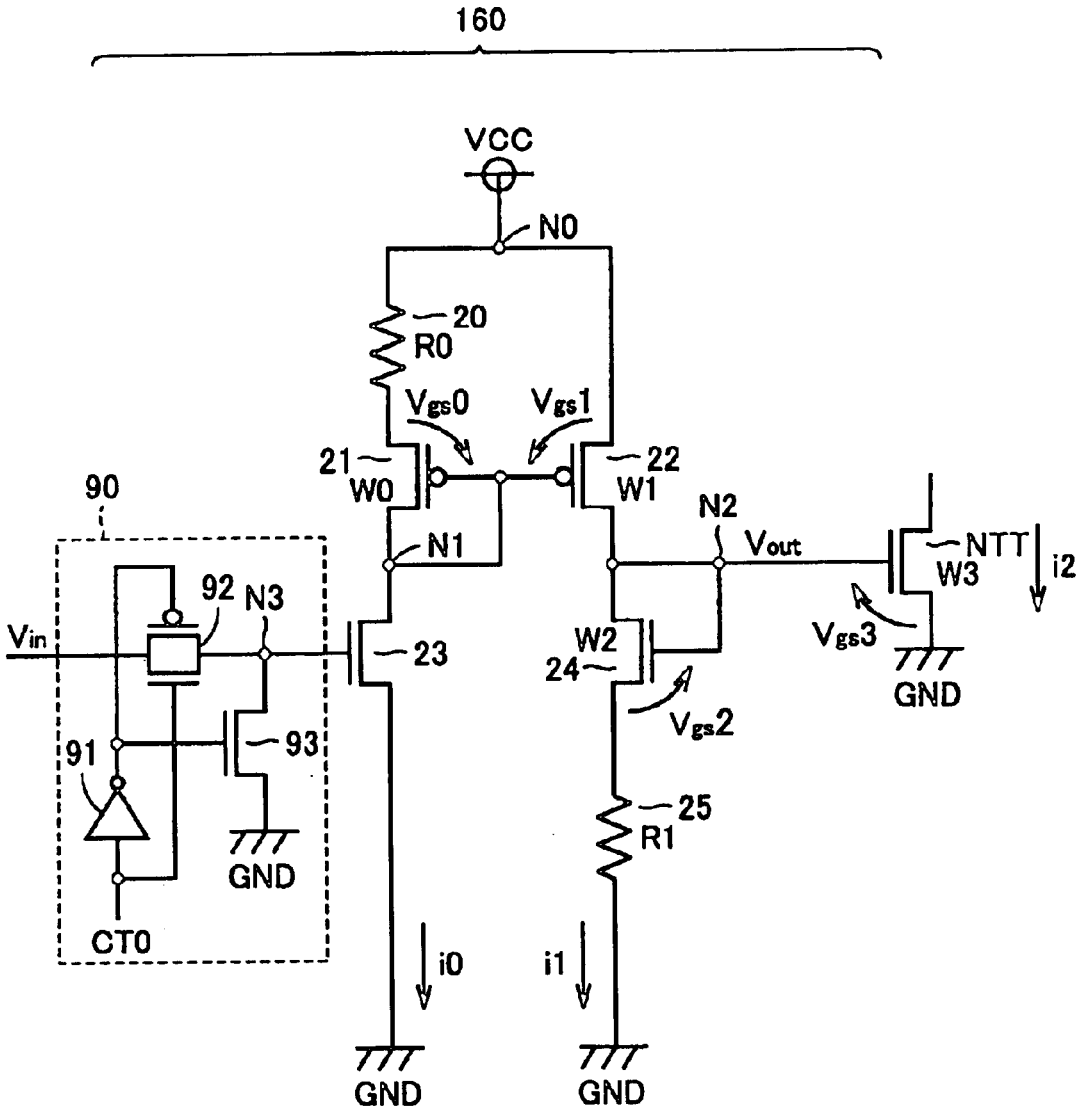
FIG. 12 is a circuit diagram showing an arrangement of a voltage adjusting circuit and a transistor according to a third embodiment of the present invention.

Referring to FIG. 12, a voltage adjusting circuit 160 according to the third embodiment of the present invention is different from voltage adjusting circuit 100 of the first embodiment in that it further includes an input voltage control circuit 90 which is connected to the gate of transistor 23 receiving input voltage Vin for controlling the voltage level of input voltage Vin. The rest of the arrangement is the same as that of voltage adjusting circuit 100 of the first embodiment shown in FIG. 3, thus the detailed description thereof will not be repeated.

Input voltage control circuit 90 includes an inverter 91, a transfer gate 92 and a transistor 93.

Transfer gate 92 receives a control signal CT0 and an inverted signal of control signal CT0 via inverter 91, and provides input voltage Vin to the gate of transistor 23. Transistor 93 is provided between a node N3 connected to the gate of transistor 23 and ground voltage GND, and receives at its gate an inverted signal of control signal CT0 via inverter 91.

For example, if control signal CT0 is at "H" level, then transfer gate 92 turns on, and input voltage Vin is input to the gate of transistor 23. If control signal CT0 is at "L" level, then transfer gate 92 turns off, and transistor 93 turns on receiving inverted signal of control signal CT0 via inverter 91. Therefore, voltage level of node N3 connected to the gate of transistor 23 will be ground voltage GND level.

Accordingly, the supply of input voltage Vin is stopped during standby state, and the voltage supplied to the gate of transistor 23 is set to ground voltage GND level ("L" level). Thus, voltage adjusting circuit 160 can be deactivated, and reduction of power consumption during standby state can be attained.

First Variation of Third Embodiment

A first variation of the third embodiment of the present invention is different from the third embodiment in that the voltage level of input voltage Vin provided to transistor 23 is adjusted during standby state, in order to reduce the power consumption.

Figure 13:
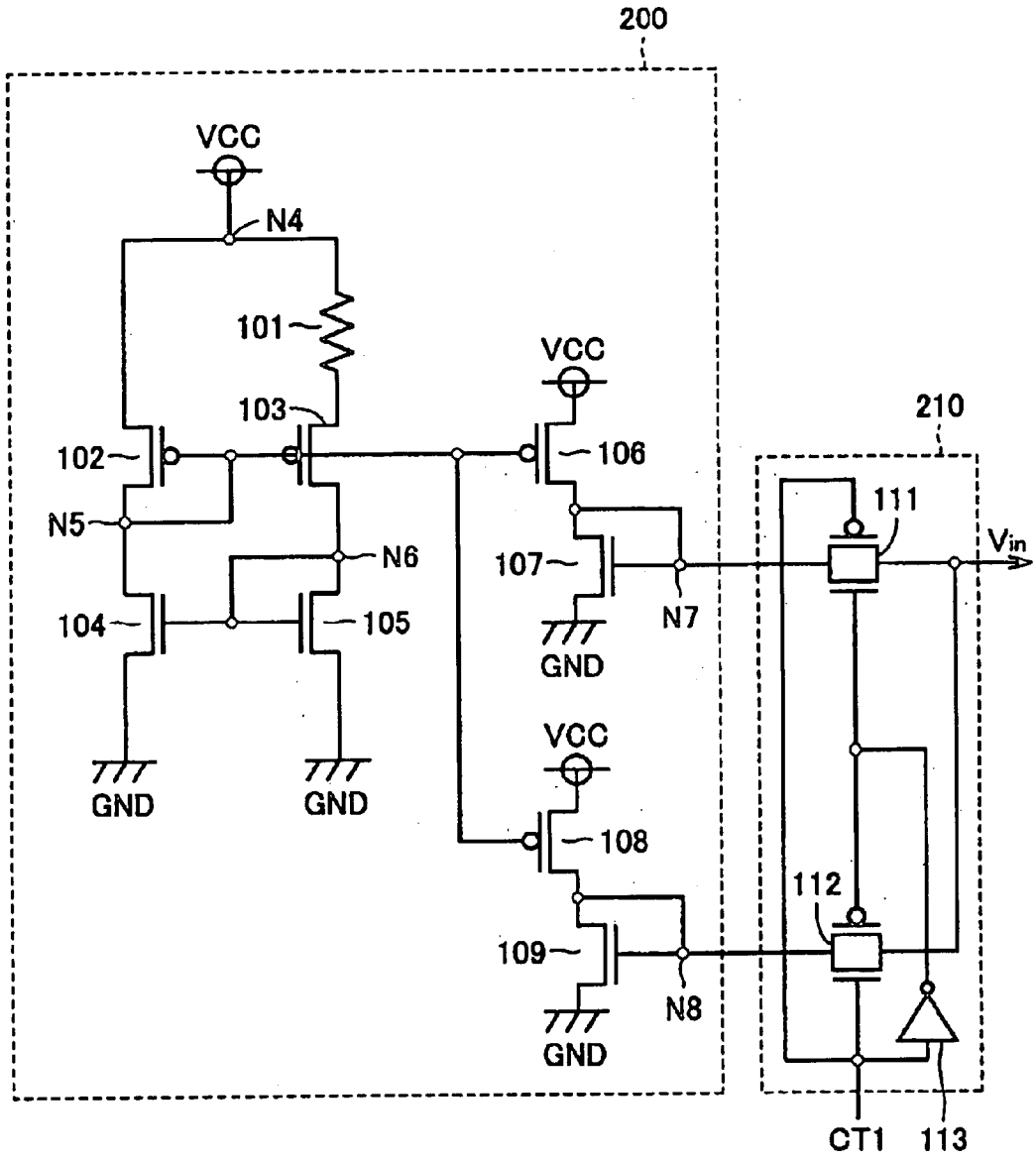
FIG. 13 is a circuit diagram showing an arrangement of a constant voltage generating circuit for generating an input voltage, and a connection control circuit according to a first variation of the third embodiment of the present invention.

Referring to FIG. 13, a constant voltage generating circuit 200 includes a resistor 101 and transistors 102 to 109. Transistor 101 is provided between a node N4 supplied with power supply voltage VCC and transistor 103. Transistor 102 is provided between node N4 and a node N5, and its gate is electrically coupled with node N5. Transistor 103 is provided between resistor 101 and a node N6 so as to form a current mirror with transistor 102, and its gate is electrically coupled with node N5. Transistor 104 is provided between node N5 and ground voltage GND, and its gate is electrically coupled with node N6. Transistor 105 is provided between node N6 and ground voltage GND so as to form a current mirror with transistor 104, and its gate is electrically coupled with node N6. Transistor 103 is provided between resistor 101 and node N6, and its gate is electrically coupled with node N5.

Transistors 106 and 107 are connected in series between power supply voltage VCC and ground voltage GND, and their gates are electrically coupled with node N5 and a node N7, respectively. Transistors 108 and 109 are connected in series between power supply voltage VCC and ground voltage GND, and their gates are electrically coupled with node N5 and a node N8, respectively. Here, as an example, transistors 102, 103, 106, and 108 are P-channel MOS transistors. Transistors 104, 105, 107 and 109 are N-channel MOS transistors. Transistors 107 and 109 have gate width different from each other.

In constant voltage generating circuit 200, transistors 104 and 105 form a current mirror circuit. If transistors 104 and 105 have sufficiently large channel resistance, then the same amount of currents flow through transistors 102 and 103 respectively, by transistors 104 and 105 forming the current mirror. Since gates of transistors 106 and 108 are electrically coupled to node N5, to which gates of transistors 102 and 103 are also coupled, the same amount of currents flow through transistors 102 and 103 as well.

Accordingly, in constant voltage generating circuit 200, the voltage levels of output nodes N7 and N8 are respectively set according to respective gate width of transistors 107 and 109.

Connection control circuit 210 includes transfer gates 111 and 112, and an inverter 113. Transfer gate 111 receives a signal at node N7, and in response to control signal CT1, outputs the received signal as an input voltage Vin. Transfer gate 112 receives a signal at node N8, and in response to control signal CT1, outputs the received signal as an input voltage Vin.

Accordingly, input voltage Vin can be switched in response to control signal CT1 in order to adjust the voltage levels of input signals input to transistor 23 during standby state.

Generally, assuming that S factor is about 0.1 V/dec and current i0 flowing through transistor 23=1 μA, then the magnitude of current can be reduced to approximately 1/10 by reducing input voltage Vin by 0.1V.

Accordingly, as described for this arrangement, by supplying input voltage Vin, which is lower than that of in normal state, to transistor 23 during standby state, the power consumption can be reduced. Further, in the third embodiment described above, since the voltage level of input voltage Vin is set to 0V during standby state, the voltage adjusting circuit is set to an inactivate state. On the other hand, since the output node of the voltage adjusting circuit has relatively large capacity, it may require some time for activation to charge output node when the voltage adjusting circuit is fully deactivated.

By employing the arrangement driving the circuit with lower power consumption during standby state, rather than fully deactivating the circuit, the activation of the voltage adjusting circuit immediately after the expiration of standby state can be accelerated.

Second Variation of Third Embodiment

Figure 14:
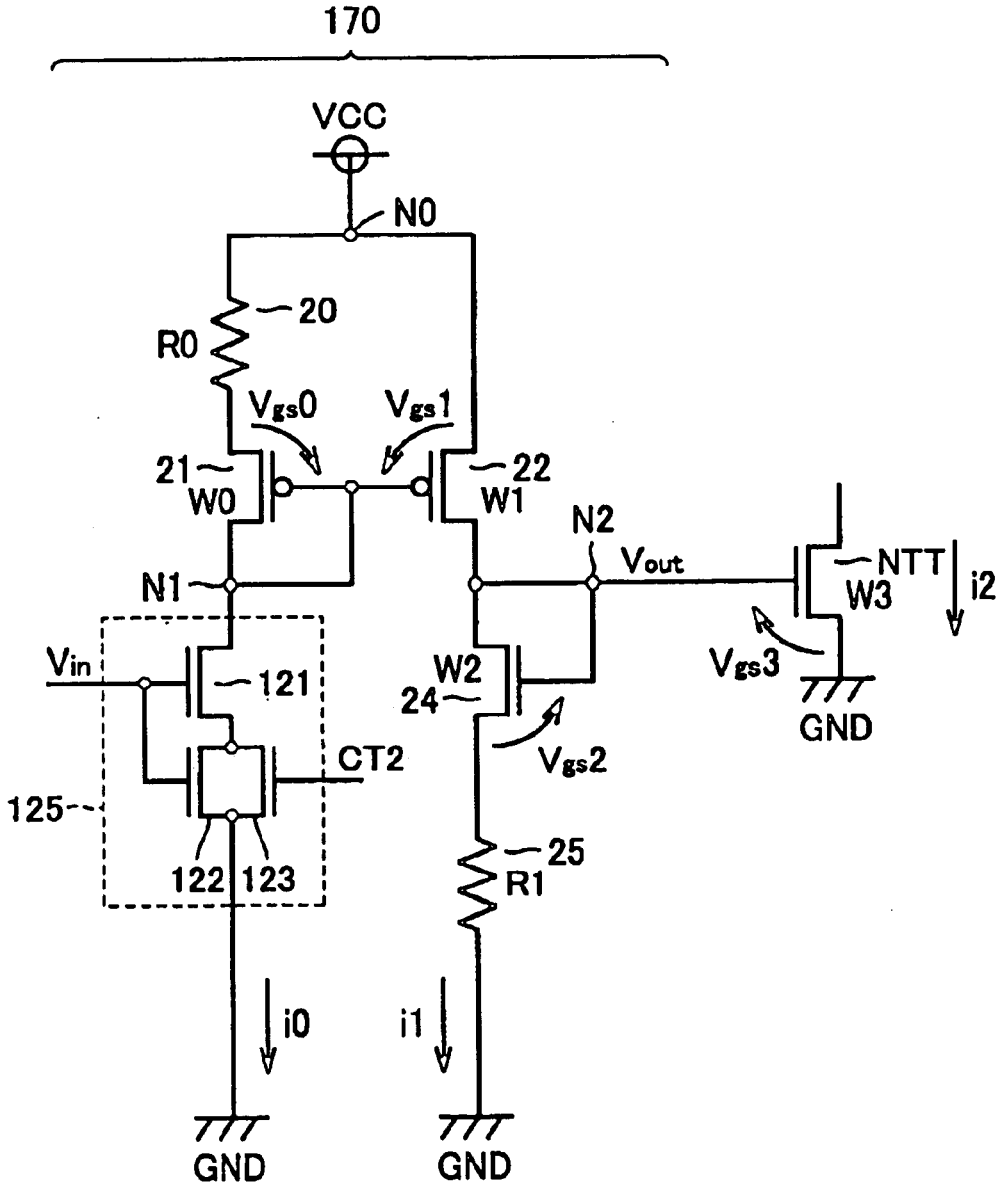
FIG. 14 is a circuit diagram showing an arrangement of a voltage adjusting circuit and a transistor according to a second variation of the third embodiment of the present invention.

Referring to FIG. 14, a voltage adjusting circuit 170 according to a second variation of the third embodiment of the present invention is different from voltage adjusting circuit 100 in that transistor 23 is replaced by a current control circuit 125. The rest of the arrangement is the same as that of voltage adjusting circuit 100 of the first embodiment shown in FIG. 3, thus the detailed description thereof will not be repeated.

Current control circuit 125 includes transistors 121 to 123. Transistors 121 and 122 are provided in series between node N1 and ground voltage GND, and their gates both receive input voltage Vin. Transistor 123 is connected between transistor 121 and ground voltage GND in parallel to transistor 122, and receives at its gate control signal CT2.

Here, if transistor widths of transistors 121 and 122 which receive input voltage Vin are in the ratio of 1:9, then in response to control signal CT2, the effective amount of current flowing through transistors 121 and 122 during standby state will be approximately 1/10 that during operation.

Thus, current control during standby state can be attained by adjusting the transistor width of transistors 121 and 122 which receive input voltage Vin, without controlling input voltage Vin directly.

Accordingly, reduction of the power consumption is achieved, enabling generation of the desired voltage level by the voltage adjusting circuit which follows temperature characteristics level during the operation mode, while adjusting the operating current amount in voltage adjusting circuit 170 during standby state.

Though the arrangements of the voltage adjusting circuit applied to the ring oscillator circuit have been described in the embodiments above, the voltage adjusting circuit of the present invention is not limited thereto, and is similarly applicable to other circuits.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor integrated circuit comprising:

a voltage adjusting circuit generating an output voltage at an output node in response to an input voltage; and an internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit directly connected between the voltage node and the output node, and connected to said second transistor unit to form a current mirror circuit with said second transistor unit, and having a gate connected to the internal node, a fourth transistor unit provided between the output node and the first voltage source, and having a gate connected to the output node, and a second resistor unit provided between said fourth transistor unit and the first voltage source, wherein said first and second resistor units have resistances that change according to variations in temperature.

2. A semiconductor integrated circuit comprising:

a voltage adjusting circuit generating an output voltage at an output node in response to an input voltage; and an internal circuit operating based on an operating current produced according to the output voltage of said voltage adjusting circuit wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, wherein said first resistor unit includes a plurality of resistor elements serially connected to each other between the voltage node and said second transistor unit, and a plurality of shorting control circuits respectively corresponding to said resistor elements for controlling shorting paths of corresponding resistor elements, third transistor unit provided between the voltage node and the output node, and connected to said second transistor unit to form a current mirror circuit with said second transistor unit, and having a gate connected to the internal node, a fourth transistor unit provided between the output node and the first voltage source, and having a gate connected to the output node, and a second resistor unit provided between said fourth transistor unit and the first voltage source, wherein said first and second resistor units have resistances that change according to variations in temperature.

3. The semiconductor integrated circuit according to claim 2, wherein resistances of said plurality of resistor elements are respectively related as powers of 2 and different from each other.

4. A semiconductor integrated circuit comprising:

a voltage adjusting circuit generating an output voltage at an output node in response to an input voltage; and an internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit provided between the voltage node and the output node, and connected to said second transistor unit to form a current mirror circuit with said second transistor unit, and having a gate connected to the internal node, a fourth transistor unit provided between the output node and the first voltage source, and having a gate connected to the output node, and a second resistor unit provided between said fourth transistor unit and the first voltage source, wherein said first and second resistor units have resistances that change according to variations in temperature, wherein said second resistor unit includes a plurality of resistor elements serially connected to each other between the first voltage source and said fourth transistor unit, and a plurality of shorting control circuits respectively corresponding to said resistor elements for controlling shorting paths of corresponding resistor elements.

5. A semiconductor integrated circuit comprising:

a voltage adjusting circuit generating an output voltage at an output node in response to an input voltage; and internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, wherein said second transistor unit includes a plurality of transistor elements provided between said first resistor unit and the internal node, connected in parallel to each other, each transistor element having a respective gate connected to the internal node, and a plurality of connection control circuits respectively provided corresponding to one of said plurality of transistor elements for controlling connection of said first resistor unit and the internal node via corresponding transistor elements, wherein said transistor elements have respective gate widths, different from each other, a third transistor unit provided between the voltage node and the output node, and connected to said second transistor unit to form a current mirror circuit with said second transistor unit, and having a gate connected to the internal node, a fourth transistor unit provided between the outpu node and the first voltage source, and having a gate connected to the output node, and a second resistor unit provided between said fourth transistor unit and the first voltage source, wherein said first and second resistor units have resistances that change according to variations in temperature.

6. The semiconductor integrated circuit comprising:

a voltage adjusting circuit generating an output voltage at an output node in response to an input voltage; and an internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit provided between the voltage node and the output node, and connected to said second transistor unit to form a current mirror circuit with said second transistor unit, and having a gate connected to the internal node, wherein said third transistor includes a plurality of transistor elements provided between the voltage node and the output node, connected in parallel to each other, each transistor element having a respective gate connected to the internal node, and a plurality of connection control circuits respectively corresponding to one of said plurality of transistor elements for controlling connection of the voltage node and the output node via corresponding transistor elements, wherein each of said transistor elements of said plurality of transistor elements has a respective gate width, different from each other, a fourth transistor unit provided between the output node and the first voltage source, and having a gate connected to the output node, and a second resistor unit provided between said fourth transistor unit and the first voltage source, wherein said first and second resistor units have resistances that change according to variations in temperature.

7. A semiconductor integrated circuit comprising:

a voltage adjusting circuit generating an output voltage at an output node in response to an input voltage; and an internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit provided between the voltage node and the output node to form a current mirror circuit with said second transistor unit, and having a gate connected to the internal node, a fourth transistor unit provided between the output node and the first voltage source, and having a gate connected to the output node, a second resistor unit provided between said fourth transistor unit and the first voltage source, wherein said first and second resistor units have resistances that change according to variations in temperature, a dummy resistor at least one of positions between the voltage node and said third transistor unit, and between said first transistor unit and the first voltage source; and shorting wiring for short-circuiting said dummy resistor.

8. The semiconductor integrated circuit according to claim 1, wherein said voltage adjusting circuit further includes a low pass circuit coupled between the voltage node of said voltage adjusting circuit and the second voltage source for removing a high frequency component from a voltage produced by the second voltage source.

9. A semiconductor integrated circuit comprising:

a voltage adjusting circuit generating an output voltage at an output node in response to an input voltage;

an internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit provided between the voltage node and the output node, and connected to said second transistor unit to form a current mirror circuit with said second transistor unit, having a gate connected to the internal node, a fourth transistor unit provided between the output node and the first voltage source, and having a gate connected to the output node, and a second resistor unit provided between said fourth transistor unit and the first voltage source, wherein said first and second resistor units have resistances that change according to variations in temperature; and an input control circuit controlling supply of the input voltage input to the gate of said first transistor unit, wherein said input control circuit stops supply of the input voltage to the gate of said first transistor unit during a standby state.

10. A semiconductor integrated circuit comprising:

a voltage adjusting circuit generating an output voltage at an output node in response to an input voltage;

an internal circuit operating based on an operating current produced according to the output voltage of said voltage adjusting circuit, wherein said voltage adjusting circuit adjusts the output voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit provided between the voltage node and the output node, and connected to said second transistor unit to form a current mirror circuit with said second transistor unit, and having a gate connected to the internal node, a fourth transistor unit provided between the output node and the first voltage source, and having a gate connected to the output node, and a second resistor unit provided between said fourth transistor unit and the first voltage source, wherein said first and second resistor units have resistances that change according to variation in temperature, and a voltage generating circuit generating the input voltage, wherein the input voltage generated by said voltage generating circuit is different in level between an operation state of said voltage adjusting circuit and a standby state of said voltage adjusting circuit.

11. A semiconductor integrated circuit comprising:

a voltage adjusting circuit generating an output voltage at an output node in response to an input voltage; and an internal circuit operating based on an operating current produced according to the output voltage of said voltage adjusting circuit, wherein said voltage adjusting circuit adjusts the outpu voltage generated at the output node in response to the input voltage so the output voltage is set in accordance with operating characteristics of said internal circuit that vary in accordance with temperature, said voltage adjusting circuit including a first transistor unit provided between a first voltage source and an internal node, and having a gate supplied with the input voltage, wherein said first transistor unit includes a first transistor element electrically coupling the internal node and the first voltage source in response to the input voltage, and a current flow control circuit provided between said first transistor element and the first voltage source for controlling current flowing through said first transistor element, wherein said current flow control circuit sets the current flowing through said first transistor unit during a standby state lower than the current flowing through said first transistor unit during an operation state, a second transistor unit provided between a voltage node coupled to a second voltage and the internal node, and having a gate connected to the internal node, a first resistor unit provided between said second transistor unit and the voltage node, a third transistor unit provided between the voltage node and the output node, and connected to said second transistor unit to form a current mirror circuit with said second transistor unit, and having a gate connected to the internal node, a fourth transistor unit provided between the output node and the first voltage source, and having a gate connected to the output node, a fourth transistor unit provided between the output node and the first voltage source, and having a gate connected to the output node, and a second resistor unit provided between said fourth transistor unit and the first voltage source, wherein said first and second resistor units have resistances that change according to variations in temperature.

12. The semiconductor integrated circuit according to claim 11, wherein said current flow control circuit includes a second transistor element provided between said first transistor element and the first voltage source, and having a gate supplied with the input voltage, and a third transistor element provided between said first transistor element and the first voltage source, connected in parallel with said transistor element, and having a gate receiving a signal activated upon entering the operation state.

13. A semiconductor integrated circuit comprising:

a voltage adjusting circuit generating an output voltage at an output node in response to an input voltage; and an oscillator operating based on an operating current, according to the output voltage of said voltage adjusting circuit, for generating a signal at an oscillation frequency, wherein said voltage adjusting circuit adjusts the output voltage generated at the output node in response to the input voltage so that the oscillation frequency changes with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit directly connected between the voltage node and the output and connected to said second transistor unit to form a current mirror circuit with said second transistor unit, and having a gate connected to the internal node, a fourth transistor unit provided between the output node and the first voltage source, and having a gate connected to the output node, and a second resistor unit provided between said fourth transistor unit and the first voltage source, wherein said first and second resistor units have resistances that change according to variations in temperature.

14. The semiconductor integrated circuit according to claim 13, wherein each of said first, second, third, and fourth transistor units includes an MOS transistor.

15. The semiconductor integrated circuit according to claim 1, wherein each of said first, second, third, and fourth transistor units includes an MOS transistor.

16. The semiconductor integrated circuit according to claim 7, wherein each of said first, second, third, and fourth transistor units includes an MOS transistor.

17. A semiconductor integrated circuit comprising:

a voltage adjusting circuit generating an output voltage at an output node in response to an input voltage; and an oscillator operating based on an operating current, according to the output voltage of said voltage adjusting circuit, for generating a signal at an oscillation frequency, wherein said voltage adjusting circuit adjusts the output voltage generated at the output node in response to the input voltage so that the oscillation frequency changes with temperature, said voltage adjusting circuit including a first transistor unit provided between a first voltage source and an internal node, and having a gate supplied with the input voltage, a second transistor unit provided between a voltage node coupled to a second voltage and the internal node, and having a gate connected to the internal node, a first resistor unit provided between said second transistor unit and the voltage node, a third transistor unit provided between the voltage node and the output node to form a current mirror circuit with said second transistor unit, and having a gate connected to the internal node, a fourth transistor unit provided between the output node and the first voltage source, and having a gate connected to the output node, a second resistor unit provided between said fourth transistor unit and the first voltage source, wherein said first and second resistor units have resistances that change according to variations in temperature, a dummy resistor at least one of positions between the voltage node and said third transistor unit, and between said first transistor unit and the first voltage source; and shorting wiring for short-circuiting said dummy resistor.

18. The semiconductor integrated circuit according to claim 17, wherein each of said first, second, third, and fourth transistor units includes an MOS transistor.

* * * * *